US009984622B2

(12) United States Patent
Tseng

(10) Patent No.: US 9,984,622 B2
(45) Date of Patent: May 29, 2018

(54) PIXEL DRIVING CIRCUIT, DRIVING METHOD THEREOF AND DISPLAY DEVICE USING THE SAME

(71) Applicant: EVERDISPLAY OPTRONICS (SHANGHAI) LIMITED, Shanghai (CN)

(72) Inventor: Yinghsiang Tseng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 6 days.

(21) Appl. No.: 15/135,714

(22) Filed: Apr. 22, 2016

(65) Prior Publication Data

US 2017/0061868 A1 Mar. 2, 2017

(30) Foreign Application Priority Data

Aug. 26, 2015 (CN) ..... 2015 1 0530440

(51) Int. Cl.
*G09G 3/20* (2006.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0262* (2013.01); *G09G 2320/043* (2013.01)

(58) Field of Classification Search
CPC ..... G09G 3/30–3/3291
See application file for complete search history.

(56) References Cited

U.S. PATENT DOCUMENTS

2005/0083271 A1* 4/2005 Suh ..... G09G 3/3233 345/76
2005/0093787 A1* 5/2005 Kim ..... G09G 3/3233 345/76
2010/0164847 A1* 7/2010 Lee ..... G09G 3/3233 345/77

* cited by examiner

*Primary Examiner* — Hang Lin
(74) *Attorney, Agent, or Firm* — Yunling Ren

(57) ABSTRACT

A pixel driving circuit includes: a switching transistor, having a first end connected with a data signal, and a control end connected with a first scan signal; a compensation transistor, having a first end connected with a second end of the switching transistor; a storage capacitor, having a first end connected with a second end and a control end of the compensation transistor, and a second end connected with a driving voltage; a driving transistor, having a first end connected with the driving voltage, and a control end connected with the first end of the storage capacitor; and an isolation transistor, having a first end connected with a second end of the driving transistor, a second end connected with the OLED, and a control end connected with a light emitting control signal, wherein the compensation transistor has a threshold voltage the same as that of the driving transistor.

6 Claims, 7 Drawing Sheets

PIXEL DRIVING CIRCUIT, DRIVING METHOD THEREOF AND DISPLAY DEVICE USING THE SAME

CROSS-REFERENCE TO RELATED APPLICATIONS

The present application is based upon and claims priority to Chinese Patent Application No. 201510530440.2, filed Aug. 26, 2015, the entire contents of which are incorporated herein by reference.

TECHNICAL FIELD

The present disclosure generally relates to the field of display technology, and more particularly, to a pixel driving circuit, a driving method of the pixel driving circuit, and a display device using the pixel driving circuit.

BACKGROUND

Compared with a liquid crystal display panel in the conventional technology, an OLED (Organic Light Emitting Diode) display panel has characteristics such as a faster response speed, better color purity and brightness, higher contrast, a wider visual angle and so on. Thus, the display technology developers are paying increasingly more attention to OLED display panels.

A pixel unit in the OLED display panel mainly includes an OLED and a pixel unit driving circuit for driving the OLED. FIG. 1 is a schematic diagram of a 2T1C pixel unit driving circuit in the prior art. As shown in FIG. 1, the 2T1C pixel unit driving circuit includes a switching transistor T1, a driving transistor DTFT and a storage capacitor Cst. The switching transistor T1 is controlled by a first scan signal Sn output from a scan line, so as to control the writing of a data signal Data of a data line. The driving transistor DTFT is used for outputting a driving current to the OLED to make the OLED emit light. The storage capacitor Cst is used to provide a maintaining voltage to a gate electrode of the driving transistor DTFT.

The organic light emitting diode OLED can emit light while it is driven by the driving current produced by the driving transistor DTFT operating in a turn-on state, wherein the driving current $I_{OLED}$ may be expressed as:

$$I_{OLED} = \frac{1}{2}\mu_n \cdot C_{OX} \cdot \frac{W}{L} \cdot (Vdata - ELVDD - Vth)^2$$

where, $\mu_n \cdot Cox \cdot W/L$ is a constant related to process and driving design, for example, $\mu_n$ is carrier mobility, Cox is gate oxide layer capacitance, W/L is a width to length ratio of the transistor; Vdata is a voltage of the data signal Data, ELVDD is a driving voltage of the driving transistor DTFT and is shared by all the pixel units, and Vth is a threshold voltage of the driving transistor DTFT.

However, due to technical limitations, uniformity of the threshold voltages Vths are usually poor, furthermore, drifting of the threshold voltage Vth will occur in use. From the above equation, it can be known that, if different pixel units have different Vths, differences exists in the driving currents, causing nonuniform of display brightness (for example, which may be up to 50% or more); and if the threshold voltage Vth of the driving transistor drifts over time, it may result in different currents over time, influencing display effect.

SUMMARY

The present disclosure aims to provide a pixel driving circuit, a driving method of the pixel driving circuit, and a display device using the pixel driving circuit, so as to the overcome one or more problems caused by the limitation and defect of the related technology at a certain degree.

The other characteristics and advantages of the present disclosure will become apparent from the following description, or may be partly learned by the practice of the present disclosure.

According to a first aspect, of the present disclosure, there is provided a pixel driving circuit of driving an OLED to emit light, including:

a switching transistor, having a first end connected with a data signal, and a control end connected with a first scan signal;

a compensation transistor, having a first end connected with a second end of the switching transistor;

a storage capacitor, having a first end connected with a second end and a control end of the compensation transistor, and a second end connected with a driving voltage;

a driving transistor, having a first end connected with the driving voltage, and a control end connected with the first end of the storage capacitor; and an isolation transistor, having a first end connected with a second end of the driving transistor, a second end connected with the OLED, and a control end connected with a light emitting control signal, wherein the compensation transistor has a threshold voltage the same as that of the driving transistor.

According to an exemplary embodiment of the present disclosure, both the compensation transistor and the driving transistor have the same structure and are symmetrically provided on a substrate.

According to an exemplary embodiment of the present disclosure, the pixel driving circuit further includes:

a reset transistor, having a first end connected with the first end of the storage capacitor, a second end connected with the second end of the driving transistor, and a control end connected with a reset signal.

According to an exemplary embodiment of the present disclosure, the reset signal is a second scan signal, the first scan signal is provided by an $N^{th}$ row scan line, and the second scan signal is provided by an $(N-1)^{th}$ row scan line.

According to an exemplary embodiment of the present disclosure, all the transistors are P-type thin film transistors, the driving voltage is a high level driving voltage, the second end of the isolation transistor is connected with an anode of the OLED, and a cathode of the OLED is connected with a low level voltage.

According to a second aspect of the present disclosure, there is provided a driving method of any one of the pixel driving circuits according to the first aspect of the present disclosure, including:

charging stage: turning on the switching transistor by using the first scan signal, and writing both the threshold voltage of the compensation transistor and the data signal into the storage capacitor; and display stage: turning on the isolation transistor by using the light emitting control signal, and turning on the driving transistor by a voltage signal stored in the storage capacitor to drive the OLED to emit light.

According to an exemplary embodiment of the present disclosure, the pixel driving circuit further includes: a reset transistor, having a first end connected with the first end of the storage capacitor, a second end connected with the second end of the driving transistor, and a control end connected with a reset signal, and the driving method further includes:

a reset stage: turning on the reset transistor by using the reset signal, and resetting the storage capacitor by the driving transistor by using the driving voltage.

According to an exemplary embodiment of the present disclosure, a buffering stage exists both between the reset stage and the charging stage and between the charging stage and the display stage.

According to a third aspect of the present disclosure, there is provided a display device, including:

a plurality of data lines, configured to provide data signals;

a plurality of scan lines, configured to provide scan signals, wherein the scan signals include a second scan signal and a first scan signal provided in sequence;

a plurality of pixel driving circuits, configured to be electrically connected to the data lines and scan lines, wherein at least one of the pixel driving circuits includes:

a switching transistor, having a first end connected with a data signal, and a control end connected with a first scan signal;

a compensation transistor, having a first end connected with a second end of the switching transistor;

a storage capacitor, having a first end connected with a second end and a control end of the compensation transistor, and a second end connected with a driving voltage;

a driving transistor, having a first end connected with the driving voltage, and a control end connected with the first end of the storage capacitor; and an isolation transistor, having a first end connected with a second end of the driving transistor, a second end connected with the OLED, and a control end connected with a light emitting control signal, wherein the compensation transistor has a threshold voltage the same as that of the driving transistor.

According to an exemplary embodiment of the present disclosure, both the compensation transistor and the driving transistor have the same structure and are symmetrically provided on a substrate.

According to an exemplary embodiment of the present disclosure, the pixel driving circuit further includes:

a reset transistor, having a first end connected with the first end of the storage capacitor, a second end connected with the second end of the driving transistor, and a control end connected with the second scan signal.

In a pixel driving circuit provided according to an exemplary implementation of the present disclosure, the compensation transistor having the threshold voltage the same as that of the driving transistor is provided, such that the threshold voltage of the compensation transistor may be prestored in the storage capacitor at the same time when the data signal is written into the storage capacitor, so as to compensate for threshold voltage drifting of the driving transistor effectively, therefore, uniformity and stability of the driving current in a display stage may be ensured, such that brightness of the OLED display panel may be more uniform.

BRIEF DESCRIPTION OF THE DRAWINGS

The exemplary implementations of the disclosure will be described in detail with reference to the accompanying drawings, through which the above and other features and advantages of the disclosure will become more apparent.

LISTING OF REFERENCE SIGNS

Figure 1:
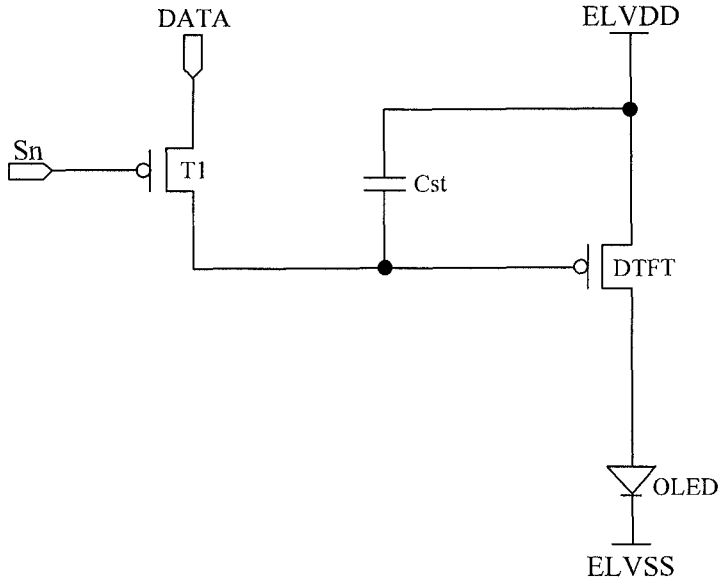
Fig. 1 (Prior Art)
FIG. 1 is a schematic diagram of a pixel driving circuit in the prior art.

T1 switching transistor
T2 compensation transistor
T3 isolation transistor
T4 reset transistor
DTFT driving transistor
Cst storage capacitor
OLED organic light emitting diode
Data data signal
Sn first scan signal
Sn-1 second scan signal
En light emitting control signal
ELVDD driving voltage
ELVSS low level voltage

DESCRIPTION OF THE EMBODIMENTS

The exemplary implementations of the present disclosure will now be described more fully with reference to the accompanying drawings. However, the exemplary implementations can be implemented in various forms and should not be understood as being limited to the implementations set forth herein; instead, these implementations are provided so that this disclosure will be thorough and complete, and the conception of exemplary implementations will be fully conveyed to those skilled in the art. In the drawings, the same reference signs denote the same or similar structures, thus their detailed description will be omitted.

In addition, the described features, structures or characteristics may be combined in one or more embodiments in any suitable manner. In the following description, numerous specific details are provided so as to allow a full understanding of the embodiments of the present disclosure. However, those skilled in the art will recognize that the technical solutions of the present disclosure may be practiced without one or more of the specific details; or other methods, components, materials and so on may be used. In other cases, well-known structures, materials or operations are not shown or described in detail to avoid obscuring various aspects of the present disclosure.

Figure 2:
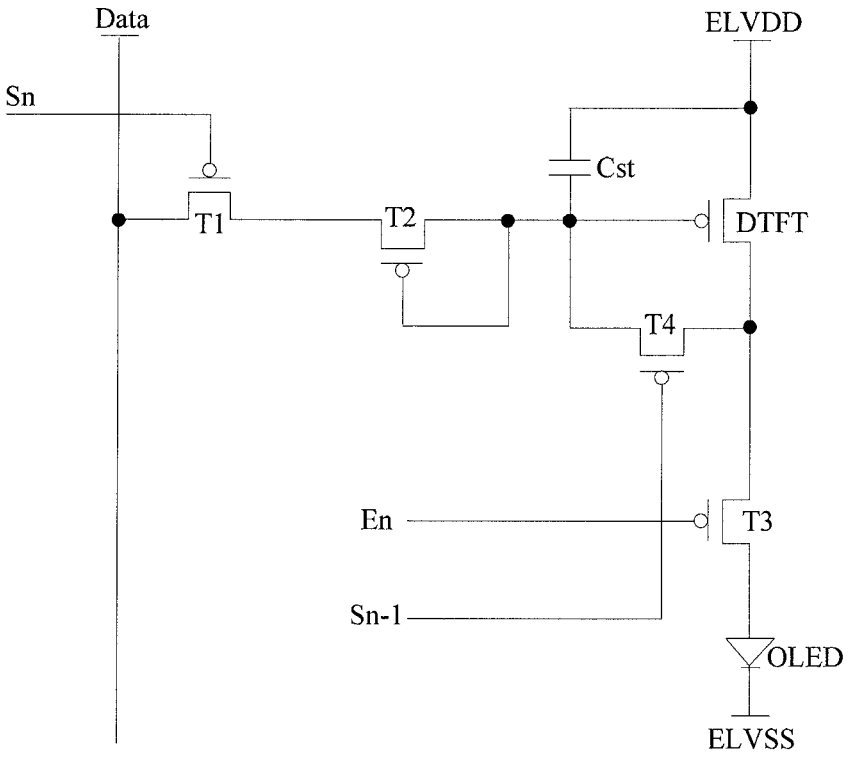
FIG. 2 is a schematic diagram of a pixel driving circuit according to an exemplary implementation of the present disclosure.

A pixel driving circuit is provided firstly according to the present exemplary implementation. As shown in FIG. 2, the pixel driving circuit mainly includes an OLED, a switching transistor T1, a compensation transistor T2, an isolation transistor T3, a storage capacitor Cst, a driving transistor DTFT and so on.

A first end of the switching transistor T1 is connected with a data signal Data, and a control end of the switching transistor T1 is connected with a first scan signal Sn. A first end of the compensation transistor T2 is connected with a second end of the switching transistor T1. A first end of the storage capacitor Cst is connected with a second end and a control end of the compensation transistor T2, and a second end of the storage capacitor Cst is connected with a driving voltage ELVDD. Therefore, under control of the first scan signal Sn, the data signal Data and a threshold voltage of the compensation transistor T2 may be prestored in the storage capacitor Cst by using the switching transistor T1 and the compensation transistor T2. A first end of the driving transistor DTFT is connected with the driving voltage ELVDD, and a control end of the driving transistor DTFT is connected with the first end of the storage capacitor Cst. Therefore, the driving transistor DTFT may be turned on or off under driving of a voltage signal stored in the storage capacitor Cst. A first end of the isolation transistor T3 is connected with a second end of the driving transistor DTFT, a second end of the isolation transistor T3 is connected with the OLED and a control end of the isolation transistor T3 is connected with a light emitting control signal En. Thus, in response to the light emitting control signal En, a driving current output by the second end of the driving transistor DTFT is applied to the OLED to make the OLED emit light.

According to the present exemplary implementation, the threshold voltage of the compensation transistor T2 is the same with that of the driving transistor DTFT. For example, by making the compensation transistor T2 and the driving transistor DTFT have the same structure and be symmetrically provided on a substrate, it may basically ensure that the compensation transistor T2 has a threshold voltage the same as that of the driving transistor DTFT. For example, when both the compensation transistor T2 and the driving transistor DTFT are prepared on an array substrate of a display panel by a thin film process, by making respective film layers of the compensation transistor T2 and the driving transistor DTFT have the same material, same thickness and symmetrical shape, both the resulting compensation transistor T2 and the driving transistor DTFT have the same structure and are symmetrically provided. In this way, when the data signal Data is written into the storage capacitor Cst, the threshold voltage of the compensation transistor T2 is prestored in the storage capacitor Cst, that is, a threshold voltage of the driving transistor DTFT is prestored in the storage capacitor Cst, which may compensate for threshold voltage drifting of the driving transistor DTFT effectively, therefore, uniformity and stability of the driving current in a display stage may be ensured, and in turn brightness of the OLED display panel may be more uniform.

Continuing to refer to FIG. 2, the pixel driving circuit according to the present exemplary implementation further includes a reset transistor T4. A first end of the reset transistor T4 is connected with the first end of the storage capacitor Cst, a second end of the reset transistor T4 is connected with the second end of the driving transistor DTFT, and a control end of the reset transistor T4 is connected with a reset signal. Therefore, the reset transistor T4 may be provided to respond to the reset signal and reset the storage capacitor Cst by using the driving voltage, so as to eliminate influence of a residual voltage signal of a last frame.

According to an exemplary implementation of the present disclosure, the above reset signal may be a second scan signal Sn-1, and the second scan signal Sn-1 is provided by a second scan line. The second scan line is a scan line preceding the first scan line (for example, the first scan signal is provided by an $N^{th}$ row scan line and the second scan signal is provided by an $(N-1)^{th}$ row scan line), so as to reduce the amount of the total control signals and control lines.

An additional advantage of the pixel driving circuit in the present embodiment is the use of single channel type transistors, which are all P-type thin film transistors. Using only P-type thin film transistors further has the following advantages: for example, a strong noise suppression; for example, because of low-level turning on, it is easier to achieve a low level in the charging management; for example, a N-type thin film transistor is vulnerable to be affected by Ground Bounce, while a P-type thin film transistor will only be affected by IR Drop of driving voltage (ELVDD) line, and generally the influence of IR Drop is easier to be eliminated; for example, manufacturing process of the P-type thin film transistor is simple, and the cost is relatively low; for example, stability of P-type thin film transistor is better, and so on. Therefore, using only P-type thin film transistors may not only reduce complexity of the manufacturing process and production cost, but also contribute to improving product quality. As shown in FIG. 2, when all the transistors are P-type thin film transistors, both the first end of the driving transistor DTFT and the second end of the storage capacitor Cst are connected with the high level driving voltage ELVDD, the second end of the isolation transistor T3 is connected with an anode of the OLED, and a cathode of the OLED is connected with a low level voltage ELVSS.

Figure 3:
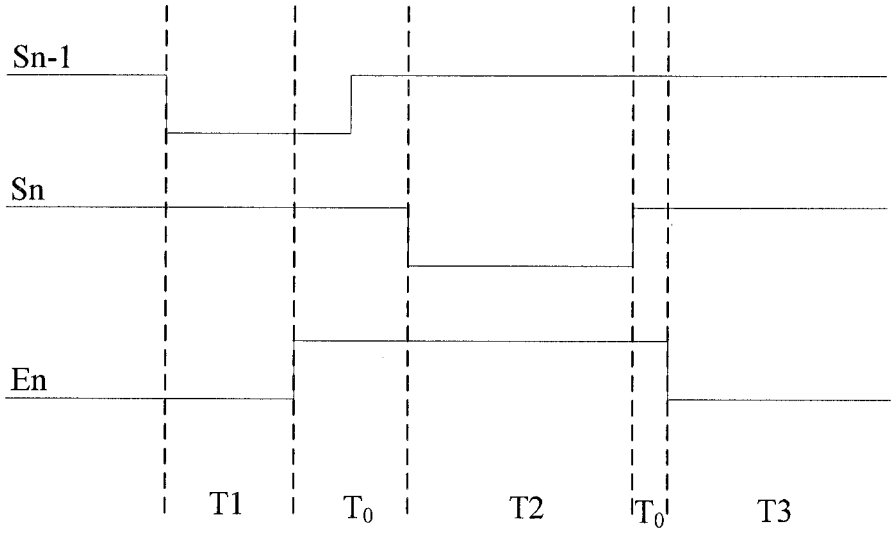
FIG. 3 is a schematic diagram of driving timing of the pixel driving circuit in FIG. 2.

Hereinafter, a driving method of the pixel driving circuit in FIG. 2 is illustrated in combination with a driving timing diagram as shown in FIG. 3. AS shown in FIG. 3, the driving method may mainly include a reset stage t1, a charging stage t2 and a display stage t3. In addition, a buffering stage $t_0$ exists both between the reset stage t1 and the charging stage t2 and between the charging stage t2 and the display stage t3, so as to avoid noise interference among respective stages.

Figure 4:
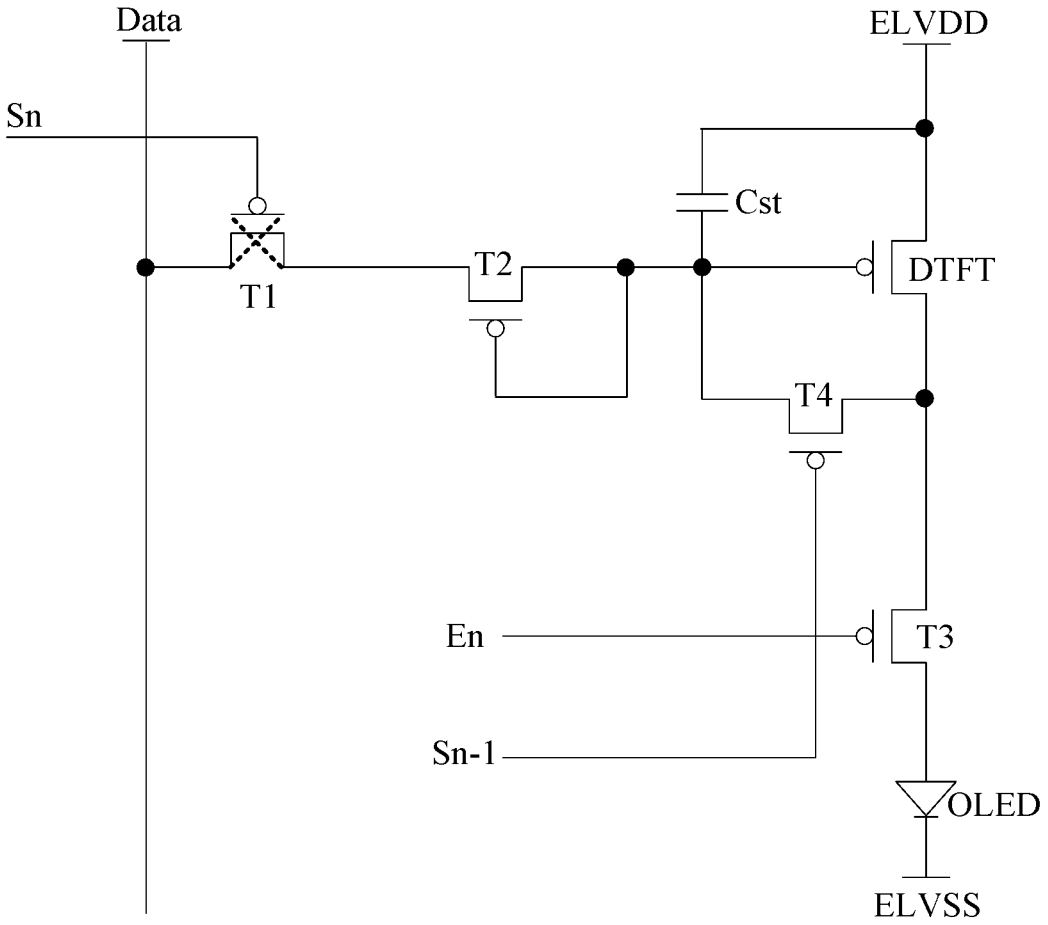
FIG. 4 is an equivalent circuit diagram of the pixel driving circuit in FIG. 2 in a reset stage.

As shown in FIGS. 3 and 4, in the reset stage t1, the first scan signal Sn is at a high level, and the switching transistor T1 is in an off state. Both a reset signal (i.e., second scan signal) Sn-1 and a light emitting control signal En are at low levels, and both the reset transistor T4 and the isolation transistor T3 are in on states. After the reset transistor T4 is turned on, both the second end and the control end of the driving transistor DTFT are shorted and form a diode connection. Therefore, the driving voltage may be applied to the first end of the storage capacitor Cst by the driving transistor DTFT, thus resetting the voltage signal of the storage capacitor Cst, eliminating influence of a residual voltage signal of the last frame.

Figure 5:
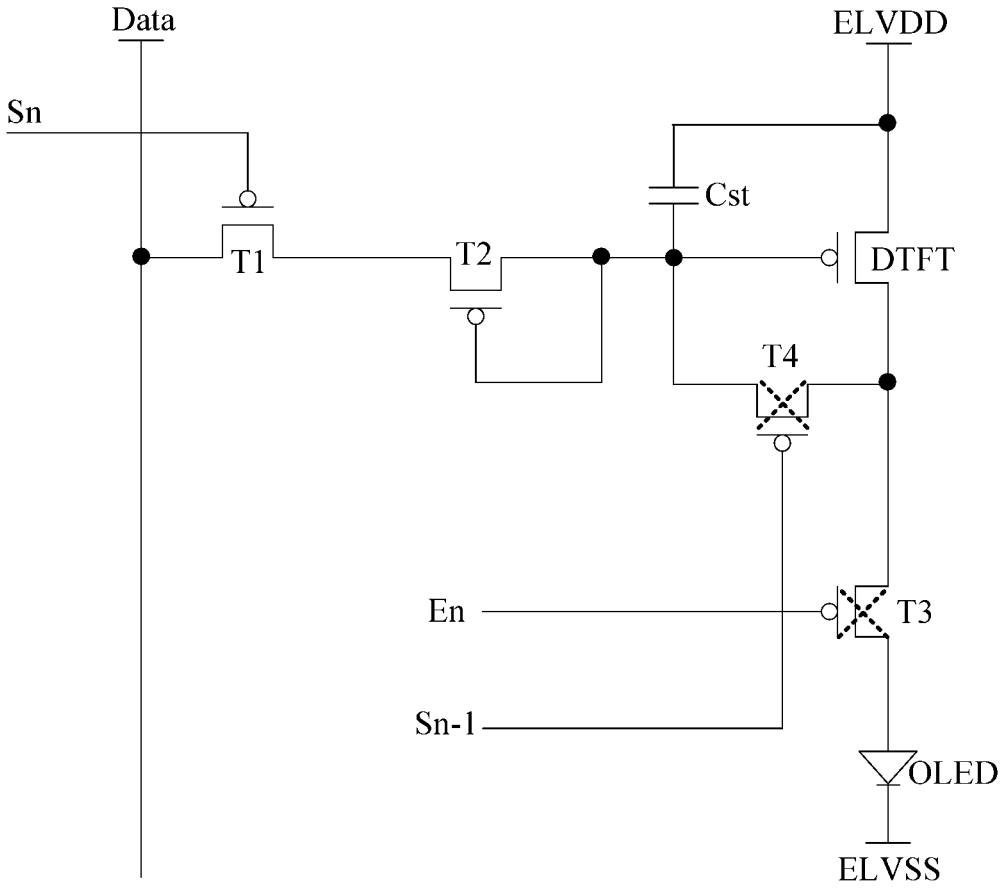
FIG. 5 is an equivalent circuit diagram of the pixel driving circuit in FIG. 2 in a charging stage.

As shown in FIGS. 3 and 5, in the charging stage t2, both the reset signal Sn-1 and the light emitting control signal En are at high levels, and both the reset transistor T4 and the isolation transistor T3 are in off states. The first scan signal Sn is at a low level, and the switching transistor T1 is in an on state. Both the second end and the control end of the compensation transistor T2 are shorted and form a diode connection. The data signal Data is written into the storage capacitor Cst via the switching transistor T1 and compensation transistor T2. At the same time, a threshold voltage Vth' of the compensation transistor T2 is also written into the storage capacitor Cst. An electric potential of the first end of the storage capacitor Cst is an electric potential $V_g$ of the control end of the driving transistor DTFT, here, $$V_g = V\text{data} + V\text{th}',$$

wherein Vdata is a level of the data signal Data, and Vth' is the threshold voltage of the compensation transistor T2.

Figure 6:
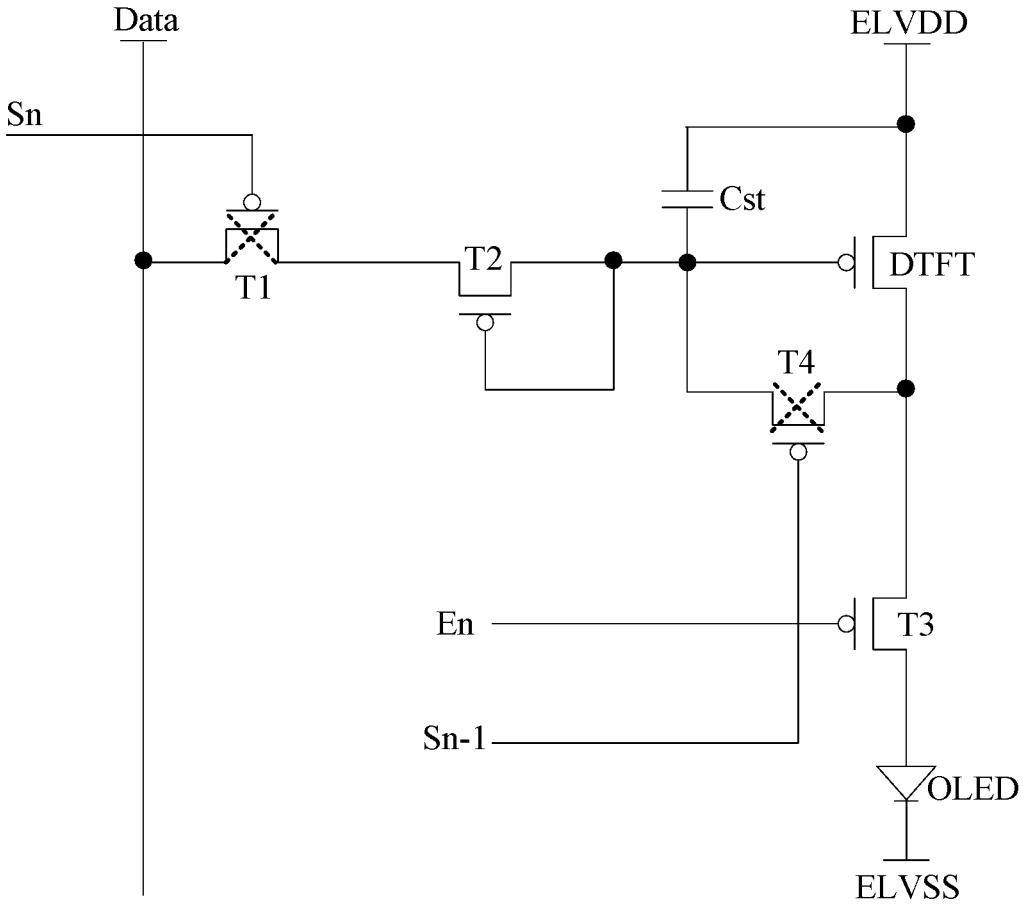
FIG. 6 is an equivalent circuit diagram of the pixel driving circuit in FIG. 2 in a display stage.

As shown in FIGS. 3 and 6, in the display stage t3, both the first scan signal Sn and the reset signal Sn-1 are at high levels, and both the switching transistor T1 and the reset transistor T4 are in off states. The light emitting control signal En is at a low level, and the isolation transistor T3 is in an on state. In this stage, an electric potential of the first end of the driving transistor DTFT is $$V_s = \text{ELVDD},$$

and then a gate-source voltage $V_{gs}$ of the driving transistor DTFT is $$V_{gs} = V_g - V_s = (V\text{data} + V\text{th}') - \text{ELVDD}$$

At this time, the driving transistor DTFT is in a turn-on state, and provides a stable driving current for the OLED; wherein the driving current of the OLED is $$I_{oled} = \frac{1}{2}\mu_n \cdot C_{OX} \cdot \frac{W}{L} \cdot (V_{gs} - Vth)^2 = \frac{1}{2}\mu_n \cdot C_{OX} \cdot \frac{W}{L} \cdot ((Vdata + Vth') - ELVDD - Vth)^2$$

where, $\mu_n \cdot Cox \cdot W/L$ is a constant related to process and driving design, and Vth is the threshold voltage of the driving transistor DTFT. Since the threshold voltage Vth of the driving transistor DTFT is the same with the threshold voltage Vth' of the compensation transistor T2, $$I_{oled} = \frac{1}{2}\mu_n \cdot C_{OX} \cdot \frac{W}{L} \cdot (Vdata - ELVDD)^2$$

It can be seen that, according to the present exemplary implementation, the driving current does not depend on the threshold voltage Vth of the driving transistor DTFT, so that the threshold voltage drifting of the driving transistor DTFT will not affect a current of its drain electrode (i.e., the driving current $I_{oled}$ of the OLED).

Figure 7:
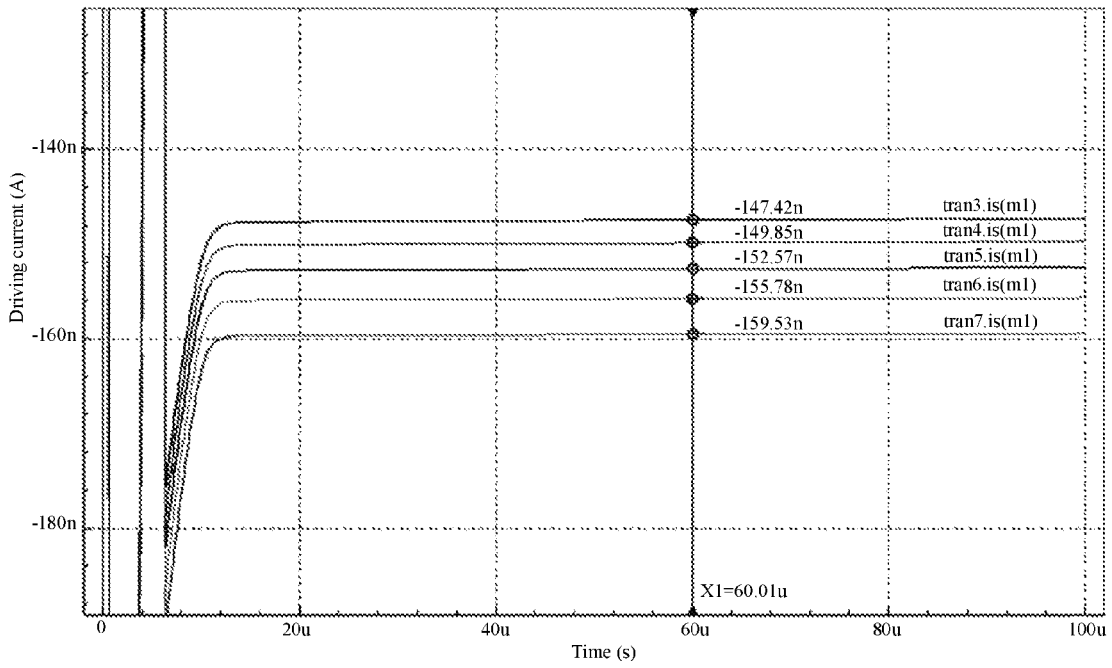
FIG. 7 is a schematic diagram of experiment effect of a pixel driving circuit according to an exemplary implementation of the present disclosure.

In addition, FIG. 7 is a simulation result of the pixel driving circuit according to the present exemplary implementation. It can be seen that, according to the present exemplary implementation, the threshold voltage drifting is compensated effectively, so that the uniformity and stability of the driving current under different threshold voltages of the driving transistor are ensured, thus the brightness of the display panel may be more uniform.

The present exemplary implementation further provides a display device. The display device includes a plurality of data lines; a plurality of scan lines, configured to provide scan signals, wherein the scan signals include a second scan signal and a first scan signal provided in sequence; a plurality of pixel driving circuits, configured to be electrically connected to the data lines and scan lines, wherein at least one of the pixel driving circuits is any one of the above pixel driving circuits according to the present exemplary implementation. Since the pixel driving circuit compensates for the threshold voltage drifting of the driving transistor DTFT, so that the OLED may be displayed stably, such that the uniformity of the display brightness of the display device is improved, and the display quality may be improved greatly.

The present disclosure has been described with reference to the above related exemplary embodiments. While the above embodiments are only examples of implementing the present disclosure. It should be pointed out that the disclosed embodiments do not limit the scope of the present disclosure. Instead, all changes or modifications without departing from the spirit and scope of the present disclosure will fall within the patent protection scope of the present disclosure.

What is claimed is:

1. A pixel driving circuit of driving an organic light emitting diode (OLED) to emit light, comprising:

a switching transistor, having a first end connected with a data signal, and a control end connected with a first scan signal;

a compensation transistor, having a first end connected with a second end of the switching transistor;

a storage capacitor, having a first end connected with a second end and a control end of the compensation transistor, and a second end connected with a driving voltage;

a driving transistor, having a first end connected with the driving voltage, and a control end connected with the first end of the storage capacitor;

an isolation transistor, having a first end connected with a second end of the driving transistor, a second end connected with the OLED, and a control end connected with a light emitting control signal; and a reset transistor, having a first end connected with the first end of the storage capacitor, a second end directly connected with the second end of the driving transistor, and a control end connected with a reset signal, wherein the compensation transistor has a threshold voltage the same as that of the driving transistor, wherein the reset signal is a second scan signal, the first scan signal is provided by an $N^{th}$ row scan line, and the second scan signal is provided by an $(N-1)^{th}$ row scan line, wherein N is a positive integer;

wherein driving of the pixel driving circuit further comprising:

a reset stage: turning on the reset transistor by using the reset signal, and resetting the storage capacitor by the driving transistor by using the driving voltage;

charging stage: turning on the switching transistor by using the first scan signal, and writing the threshold voltage of the compensation transistor and the data signal into the storage capacitor; and display stage: turning on the isolation transistor by using the light emitting control signal, and turning on the driving transistor by a voltage signal stored in the storage capacitor to drive the OLED to emit light.

2. The pixel driving circuit according to claim 1, wherein both the compensation transistor and the driving transistor have the same structure and are symmetrically provided on a substrate.

3. The pixel driving circuit according to claim 1, wherein all transistors are P-type thin film transistors, the driving voltage is a high level driving voltage, the second end of the isolation transistor is connected with an anode of the OLED, and a cathode of the OLED is connected with a low level voltage.

4. The driving method according to claim 1, wherein a buffering stage exists both between the reset stage and the charging stage and between the charging stage and the display stage.

5. A display device, comprising:

a plurality of data lines, configured to provide data signals;

a plurality of scan lines, configured to provide scan signals, wherein the scan signals comprise a second scan signal and a first scan signal provided in sequence;

a plurality of pixel driving circuits, configured to be electrically connected to the data lines and scan lines, wherein at least one of the pixel driving circuits comprises:

a switching transistor, having a first end connected with a data signal and a control end connected with the first scan signal;

a compensation transistor, having a first end connected with a second end of the switching transistor;

a storage capacitor, having a first end connected with a second end and a control end of the compensation transistor, and a second end connected with a driving voltage;

a driving transistor, having a first end connected with the driving voltage, and a control end connected with the first end of the storage capacitor;

an isolation transistor, having a first end connected with a second end of the driving transistor, a second end connected with an organic light emitting diode (OLED), and a control end connected with a light emitting control signal, and a reset transistor, having a first end connected with the first end of the storage capacitor, a second end directly connected with the second end of the driving transistor, and a control end connected with the second scan signal, wherein the compensation transistor has a threshold voltage the same as that of the driving transistor, wherein the first scan signal is provided by an $N^{th}$ row scan line, and the second scan signal is provided by an $(N-1)^{th}$ row scan line, wherein N is a positive integer;

wherein driving of the display device further comprising:

a reset stage: turning on the reset transistor by using the second scan signal, and resetting the storage capacitor by the driving transistor by using the driving voltage;

charging stage: turning on the switching transistor by using the first scan signal, and writing the threshold voltage of the compensation transistor and the data signal into the storage capacitor; and display stage: turning on the isolation transistor by using the light emitting control signal, and turning on the driving transistor by a voltage signal stored in the storage capacitor to drive the OLED to emit light.

6. The display device according to claim 5, wherein both the compensation transistor and the driving transistor have the same structure and are symmetrically provided on a substrate.

* * * * *